US006865867B1

(12) United States Patent
Zucchini

(10) Patent No.: US 6,865,867 B1
(45) Date of Patent: Mar. 15, 2005

(54) TRACTION STIRRUP INSERT

(76) Inventor: Michael R. Zucchini, 15906 Via Palo, P.O. Box 2362, Rancho Santa Fe, CA (US) 92067

( * ) Notice: Subject to any disclaimer, the term of this patent is extended or adjusted under 35 U.S.C. 154(b) by 51 days.

(21) Appl. No.: 10/662,542

(22) Filed: Sep. 15, 2003

Related U.S. Application Data

(63) Continuation-in-part of application No. 29/183,316, filed on Jun. 10, 2003, now Pat. No. Des. 491,698.

(51) Int. Cl.[7] ..... B68C 3/00
(52) U.S. Cl. ..... 54/47
(58) Field of Search ..... 54/47, 48, 49.5

(56) References Cited

U.S. PATENT DOCUMENTS

| | | | | |
|---|---|---|---|---|
| 223,577 A | | 1/1880 | Brower | |
| 250,466 A | | 12/1881 | Waehlte | |
| 283,310 A | * | 8/1883 | Williamson | 54/47 |
| 376,526 A | | 1/1888 | Jennings et al. | |
| 807,793 A | | 12/1905 | Thompson | |
| 898,683 A | | 9/1908 | Riley | |
| 1,068,828 A | | 7/1913 | Stoltman | |
| 1,096,882 A | | 6/1914 | Chappell | |
| 1,160,082 A | | 11/1915 | Jarvis | |
| 1,276,819 A | | 8/1918 | Sklar | |
| 1,639,073 A | * | 8/1927 | Berbaum | 54/47 |
| 3,905,179 A | * | 9/1975 | Bischeltsrieder | 54/47 |
| 4,209,962 A | | 7/1980 | Forest | |
| 5,172,538 A | | 12/1992 | Luger | 54/47 |
| 5,930,986 A | | 8/1999 | Meaghan et al. | 54/47 |
| 6,062,007 A | | 5/2000 | Cargill | 54/47 |
| 6,173,558 B1 | | 1/2001 | Burke, Jr. | 54/47 |
| 2003/0145564 A1 | * | 8/2003 | Chang | 54/48 |

* cited by examiner

*Primary Examiner*—Robert P. Swiatek
(74) *Attorney, Agent, or Firm*—Barlow, Josephs & Holmes, Ltd.

(57) ABSTRACT

An equestrian stirrup insert for enhancing the stability and traction of the stirrup foot plate. In this regard, the present invention provides for a traction enhancing insert assembly that is installed into the foot plate of stirrups. The insert is formed from milled aluminum. The milled aluminum plate provides a durable surface that has greatly improved wear characteristics. The assembly includes a top traction surface that is placed onto the foot plate of the stirrup. A mounting plate is placed beneath the stirrup and connected to the underside of the traction surface using fasteners. Since the insert is rigidly fixed to the stirrup using fasteners, the insert is prevented sliding in the stirrup. In this manner, the rigid relation ship between the insert and the foot plate of the stirrup allows for enhanced force transfer from the rider's foot into the stirrup with a greatly reduced potential for the insert to slip relative to the stirrup.

18 Claims, 4 Drawing Sheets

TRACTION STIRRUP INSERT

CROSS-REFERENCE TO RELATED APPLICATIONS

This application is a continuation in part of earlier filed design patent application Ser. No. 29/183,316, filed Jun. 10, 2003, now U.S. Pat. No. Des. 491,698.

BACKGROUND OF THE INVENTION

The present invention relates generally to a stirrup insert for use in equestrian riding. More particularly, the present invention relates to a stirrup insert that is rigidly attached to an equestrian riding stirrup to improve the traction of the stirrup and better retain the rider's foot under demanding riding conditions.

Typical equestrian riding gear includes a saddle with stirrups attached to straps extending from the saddle for receiving the feet of a rider. Clearly, the stirrups are an integral part of the riding equipment used by most equestrian riders. In general, riders use stirrups to retain or secure their feet thereby allowing them to maintain their balance while riding and while performing various riding maneuvers. Moreover, riders use stirrups to maintain proper posture and maneuverability while negotiating obstacles and clearing jumps. To further maintain the proper relationship between the rider's mounted position and the horse, the weight of the rider seated upon the saddled horse is distributed in a balanced manner through the saddle and the stirrups.

When the horse is in forward motion, the rider's feet in the stirrups act as a natural suspension system through flexion of the ankle joints. The rider places the ball of his foot on the base of the stirrup and by the controlled flexion of the ankle joint, the rider can create a natural suspension system. This type of riding is most prevalent in English riding, and especially in jumping. Sufficient suspension of the rider is necessary to maintain proper balance for performance purposes as well as safety. In addition, proper suspension must be maintained to avoid unnecessary adverse contact of the rider on the horse's back thereby avoiding injury to the horse. In jumping, the problem is compounded by increased dynamic forces generated directly and the point where the rider's foot is in contact with the stirrups. The amount of downward pressure on the stirrups is dependent upon the rider's weight, forward momentum, position, the amount of contact in the seat of the saddle and the height of the jump. With greatly changing dynamic at this critical contact point, it is clear that the rider's foot must maintain positive contact with the stirrup. Should contact be lost, the riser cannot maintain the proper balance and suspension required to remain on the horse, as a result the rider's foot may slip out of the stirrup in the middle of a jumping maneuver with disastrous consequences.

In competitive show jumping, for example, a rider navigates around a course containing several jumps, usually more than a dozen, which are set at prescribed heights depending upon the qualifications of the rider. Therefore, in this environment a rider would encounter both normal riding conditions and jumping conditions in rapid and alternating succession resulting in frequent and substantial variations in the dynamic forces between the rider's foot and the stirrup.

In conventional stirrups, the side bars and the footplate are an integral piece or the footplate is attached to the side bars such that the footplate is rigidly attached to the ends of the side bars. The stirrups hang down from the saddle generally in a vertical plane, perpendicular to the ground, with the footplate being generally parallel to the ground. The foot plate generally includes a central opening to receive an insert to enhance the frictional interface between the bottom of the rider's boot and the surface of the stirrup. The standard prior art insert is a rubber insert that has a ribbed top surface and two rubber hooks extending from the bottom surface thereof to engage the foot plate adjacent the opening. While this configuration is well suited to the forces exerted during casual riding, these inserts are easily dislodged during more strenuous riding maneuvers, particularly jumping.

Another prior art attempt at providing a suitable insert includes the provision of a rubber pad with bendable metal arms attached thereto. The arms are designed to be bent around the foot plate of the stirrup to hold the pad in place. These pads however are easily torn from the metal arms under the dynamic stresses encountered in jumping. Further, because the fastening means provides a small degree of latitude in lateral motion, the arms are subjected to a high degree of dynamic stress causing them to bend or break.

There is therefore a need for a novel stirrup insert that is rigidly attached to the foot plate of a stirrup while providing an enhanced traction surface to retain the rider's foot. There is a further need for a durable stirrup insert that maintains its functionality under the dynamic loading typically associated with equestrian jumping.

BRIEF SUMMARY OF THE INVENTION

In this regard, the present invention provides for a traction enhancing insert assembly that is installed into the foot plate of stirrups. The insert assembly of the present invention is formed from milled aluminum. The milled aluminum plate provides a durable surface that has greatly improved wear characteristics as compared to the prior art. The assembly includes a top traction surface that is placed onto the foot plate of the stirrup. A mounting plate is placed beneath the stirrup and connected to the underside of the traction surface using fasteners. Since the insert is rigidly fixed to the stirrup using fasteners, the insert is prevented sliding in the stirrup like the inserts of the prior art. In this manner, the rigid relation ship between the insert and the foot plate of the stirrup allows for enhanced force transfer from the rider's foot into the stirrup with a greatly reduced potential for the insert to slip relative to the stirrup.

To further enhance the rigid relationship between the insert and the foot plate of the stirrup, a resilient gasket material may be provided between the bottom of the traction surface and the foot plate of the stirrup before the mounting plate and fasteners are installed. Once the fasteners are tightened the gasket is compressed to retain the insert in the installed position.

An additional feature that enhances the functionality pf the device is the provision of raised structures, such as pyramidal shaped lugs, on the top of the traction surface to provide an enhanced grip between the stirrup and the rider's shoes. Further, since the material from which the insert is fabricated is durable, wear of the insert is greatly reduced.

Accordingly, one of the objects of the present invention is the provision of a durable and rigidly attached traction insert for a stirrup. Another object of the present invention is the provision of a removable stirrup insert that is rigidly mounted to the foot plate of the stirrup that eliminates the possibility of the insert becoming dislodged during demanding equestrian maneuvers. A further object of the present invention is the provision of a durable, rigid traction insert for a stirrup that is rigidly attached to the foot plate of a stirrup in a manner that prevents both the insert and the rider's foot from shifting when placed under a high degree of lateral loading.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
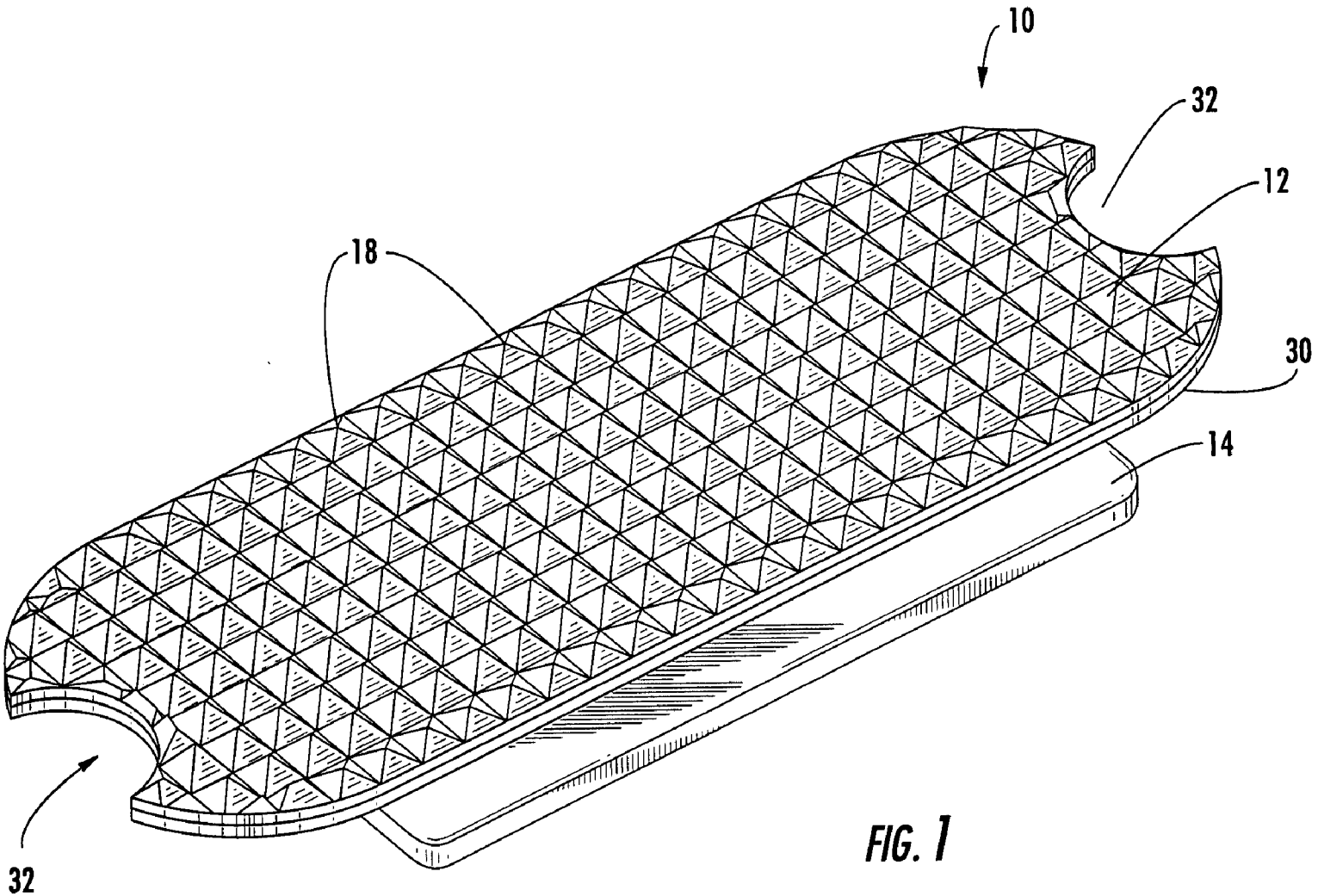
FIG. 1 is a top perspective view of the stirrup insert of the present invention.

Referring now to the drawings, the traction insert assembly of the present invention is illustrated and generally indicated at 10 in FIGS. 1-4. As will hereinafter be more fully described, the traction insert 10 generally includes a top traction plate 12, a bottom mounting plate 14 and fasteners 16 to connect the top traction plate 12 and bottom mounting plate 14 to one another. In general terms, the traction plate 12 is placed above the foot plate of an equestrian stirrup, the mounting plate 14 is placed below the foot plate and the two pieces are fastened in a fixed position around the foot plate. The present invention therefore provides a convenient and durable traction insert 10 for a stirrup that has not been previously available in the prior art.

Figure 2:
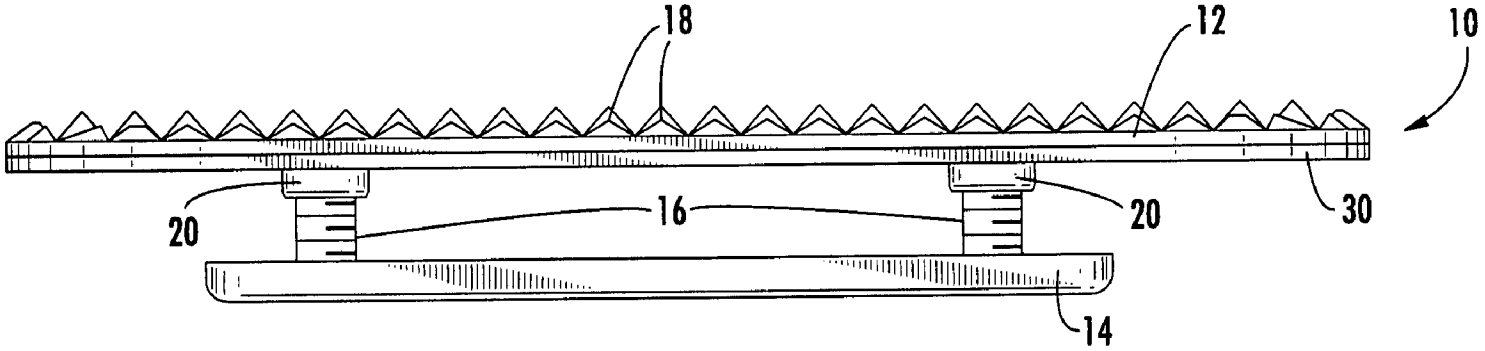
FIG. 2 is a side view thereof.

Turning to FIGS. 1 and 2, it can be seen that the traction insert 10 includes a top traction plate 12. The top traction plate 12 can be formed from any suitable material. In the preferred embodiment the traction plate 12 is formed from an aluminum plate thereby forming a highly durable wearing surface as compared to the rubber inserts of the prior art. The traction plate 12 includes surface enhancements 18 on the top surface thereof. The traction enhancements 18 are configured to provide optimal friction between the traction plate 12 and the sole of the rider's boots. As can be understood, the dynamic forces encountered during equestrian riding and jumping are all transferred from the rider to the saddle and horse through this contact point between the rider's boot and the traction plate 12, thereby necessitating a that high level of frictional force be maintained at this point. The traction enhancements 18 may consist of a knurled surface, milled lines or as seen in the preferred embodiment, pyramidal structures. Although a particular configuration is shown herein, any type of traction enhancements 18 could be utilized and fall within the scope of the present invention.

The bottom side of the traction plate 12, opposite the top side, has holes therein to receive fasteners. The holes may further include lugs 20 that extend downwardly thereform to strengthen the point of attachment for the fasteners 16 and provided an extended threaded surface for screw type fasteners 16. As will be fully described below, the traction plate 12 is placed onto the top side of the foot plate of a stirrup to enhance the traction thereof.

The mounting plate 14 may also be fashioned from any suitable material. Again, in the preferred embodiment, the mounting plate 14 is fashioned from aluminum. The mounting plate 14 has holes through which fasteners 16 are installed to attach the mounting plate 14 to the traction plate 12. The mounting plate 14 is placed beneath the bottom surface of the stirrup foot plate in alignment with the traction plate 12.

The fasteners 16 used to connect the mounting plate 14 to the traction plate 12 are preferably screws 16, but could be rivets or any other suitable fastener 16. The fasteners 16 extend through openings in the mounting plate 14 and into the holes provided in the bottom of the traction plate 12.

Figure 3:
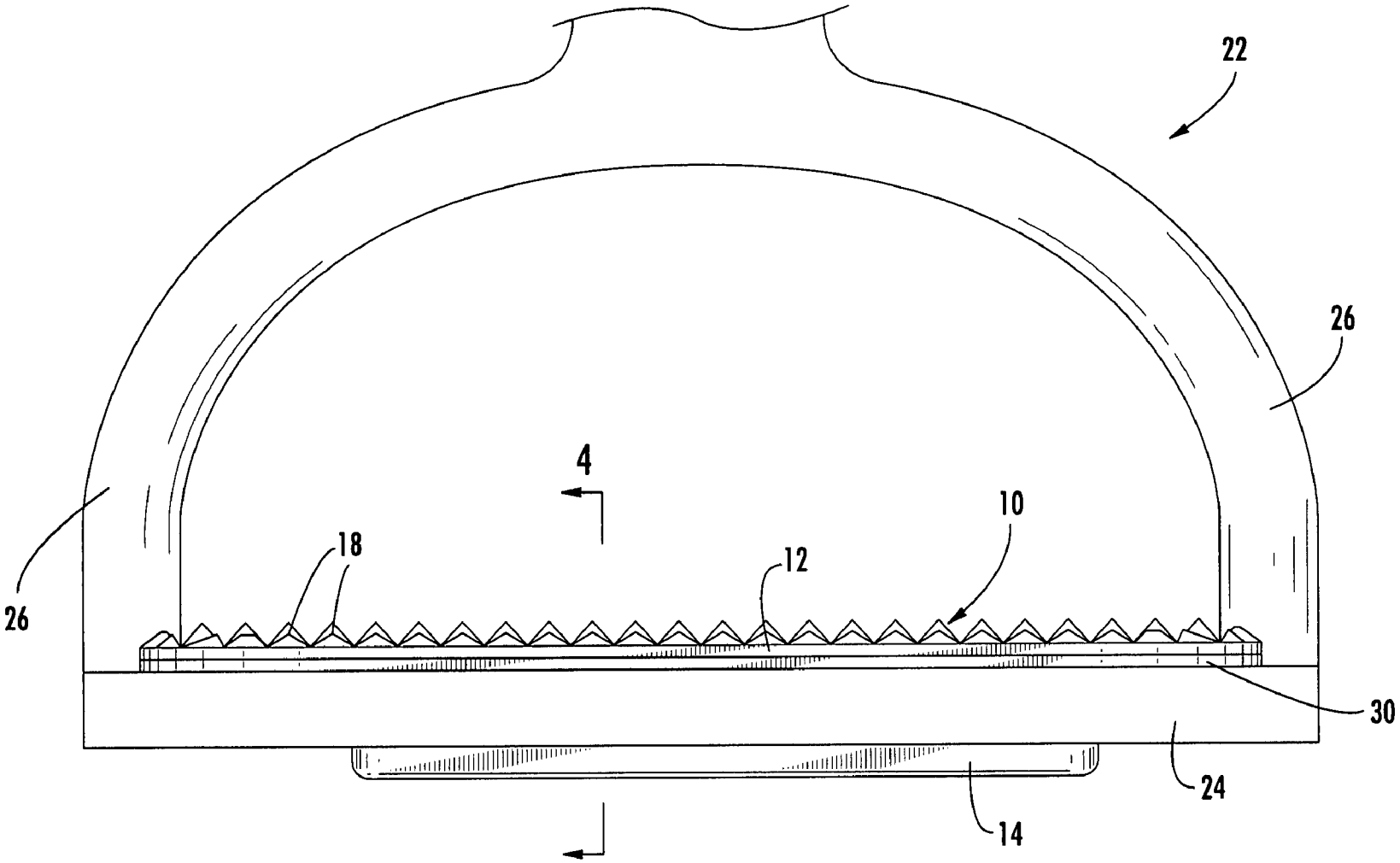
FIG. 3 is a side view of the stirrup insert installed into an equestrian stirrup.
Figure 4:
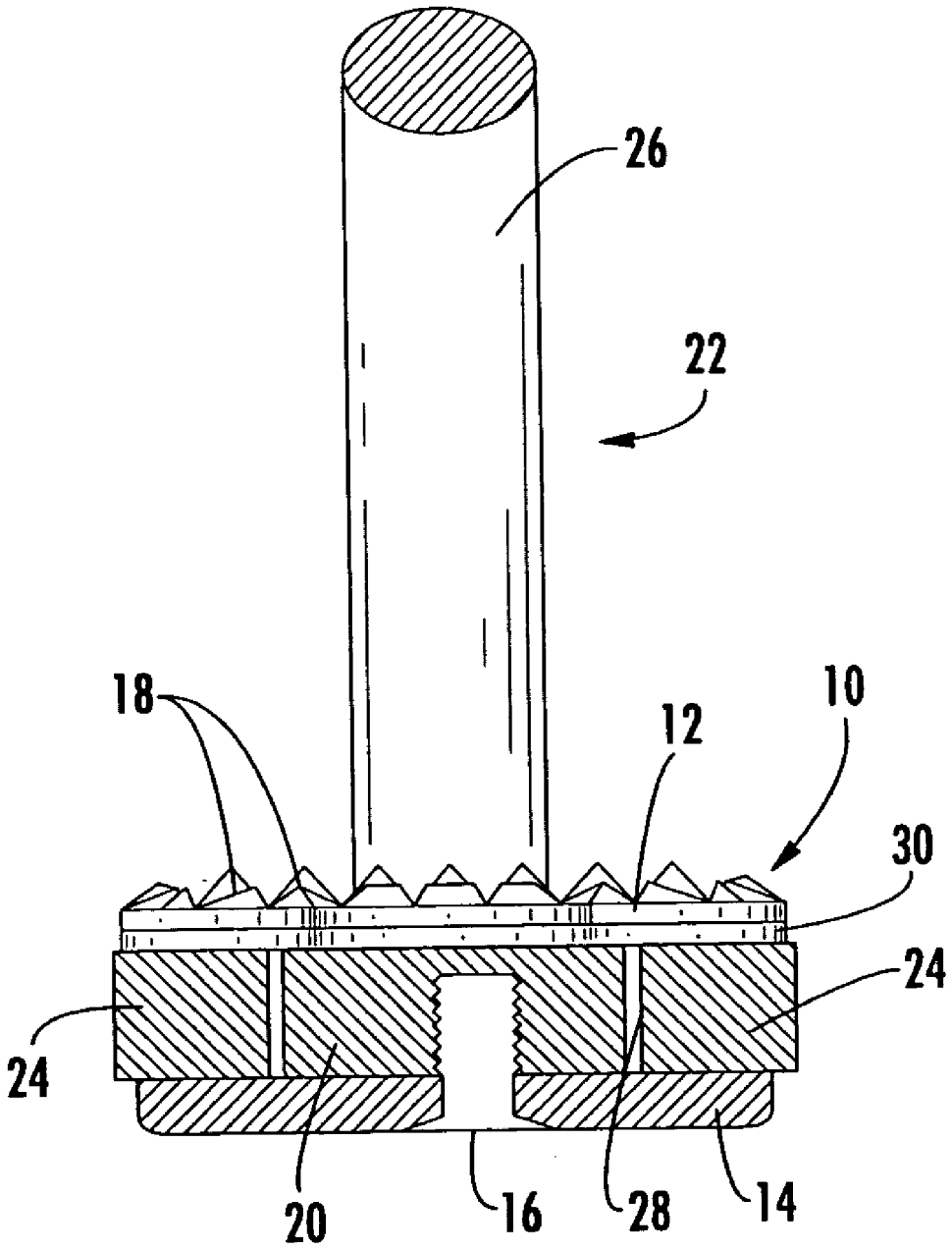
FIG. 4 is a cross-sectional view thereof as taken along line 4—4 of FIG. 3.

Turning to FIGS. 3 and 4, the traction insert 10 of the present invention is shown in operable relation to a conventional equestrian stirrup 22. The stirrup 22 can be seen to include a foot plate 24 designed to carry the vertical load from a rider's foot. The foot plate 24 is connected to a yoke 26 that has two arms. The two arms of the yoke 26 are traditionally rigidly connected to the two ends of the foot plate 24 thereby forming an opening into which the rider places the toe of his/her foot. The foot plate 24 further includes an opening 28 in the center thereof to receive a traction insert such as the prior art rubber inserts. As can be seen, the traction plate 12 of the present invention is placed on top of the foot plate 24 of the stirrup 22 so that the traction enhancements 18 are in a position to contact the bottom of the rider's shoe. The mounting plate 14 is placed into position beneath the foot plate 24 of the stirrup 22 and is attached to the traction plate 12 with fasteners 16 that extend through the mounting plate 14, the opening 28 in the foot plate 24 and into the bottom of the traction plate 12. The fasteners 16 are installed so as to draw the traction plate 12 and the mounting plate 14 together. Once the screws 16 are tightened, the traction insert 10 is rigidly affixed to the foot plate 24 of the stirrup 22.

Figure 2A:
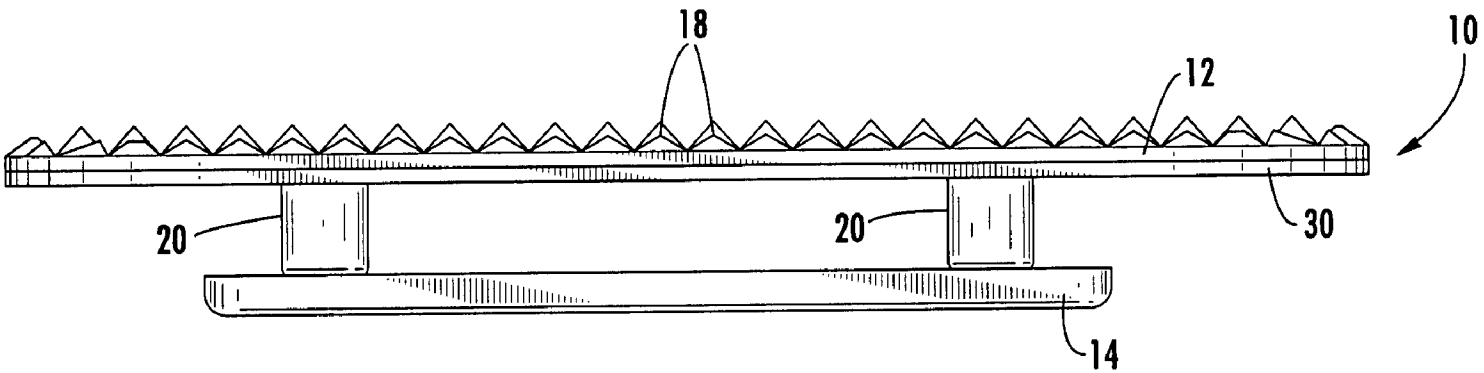
FIG. 2*a* is a side view thereof showing the addition of mounting lugs.

As was described above, the traction plate 12 may or may not include lugs 20 on the bottom surface thereof. The lugs 20 serve two functions. First, the lugs 20 provide a deeper area for the engagement of the fasteners 16 thereby reducing the possibility that the fasteners 16 pull out from the traction plate 12. Second the lugs 20 provide additional stability and enhance the rigidity of the interface between the stirrup 22 and the traction insert 10. The lugs 20 can be fashioned to extend across the entire width of the opening 28 in the foot plate 24 thereby preventing the traction plate 12 from shifting around in the opening 28 provided in the foot plate 24. Further, as is illustrated in FIGS. 2 and 2*a*, the lugs 20 may extend to a depth that is slightly shorter than the thickness of the foot plate 24 to allow the fasteners 16 to be installed in a tight fashion drawing the traction plate 12 and mounting plate 14 against the foot plate 24 of the stirrup 22 while providing a positive stop point to prevent distorting the traction 12 or mounting plates 14. In this manner the rigidity of the attachment between the traction insert 10 and foot plate 24 is further enhanced.

Additionally, surface enhancements may be provided on the bottom side of the traction plate 12 to limit the slippage between the traction plate 12 and the foot plate 24 of the stirrup 22. These enhancements may be milled into the surface of the bottom side of the traction plate 12 in the form of knurling. Alternatively, a compressible gasket 30 material may be placed between the traction plate 12 and the foot plate 24 of the stirrup 22 to limit the slippage. The gasket 30 may be formed from rubber, neoprene, nylon or any other suitable material well known in the art.

Finally, as can be best seen in FIGS. 1 and 3, the ends of the traction plate 12 may include notches 32. The notches 32, if present, may be at one end of the traction plate 12 or at both ends. The primary function of the notches 32 is to provide a relief area in the traction insert 10 where the arm of the yoke 26 contacts the foot plate 24. However, the notches 30 may provide the additional advantage of engaging the arm of the yoke 26 thereby preventing the traction plate 12 from shifting laterally relative to the foot plate 24.

In the manner described above, the traction insert 10 is rigidly installed into the foot plate 24 of a stirrup 22. The traction insert 10 is particularly constructed to eliminate the slippage encountered in the prior art. In particular, the two plate construction serves to create a rigid and durable attachment configuration that allows the dynamic forces encountered during equestrian jumping to be efficiently and reliably transferred from the riders boot into the stirrup 22. This reliable interface reduces the possibility that the rider's foot become dislodged resulting in the loss of balance and injury to the rider. Further the durable materials enhance the overall useful life and reliability of the traction insert 10 of the present invention.

It can therefore be seen that the present invention provides a durable and rigid traction insert 10 that enhances the performance of an equestrian stirrup over a great range of riding conditions. Further, the present invention can be modified to accommodate a number of standard stirrup 22 configurations while maintaining the high level of performance and a reliable transfer of the dynamic riding forces from the foot of the rider to the foot plate 24 of the stirrup 22. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A traction plate assembly for rigid mounting to an equestrian stirrup, said stirrup including a yoke and a foot plate connected to said yoke, said traction plate assembly comprising:

a top plate, said top plate having a top traction surface and a bottom mounting surface, said top plate received above said foot plate;

a mounting plate, said mounting plate received below said foot plate; and fasteners, said fasteners extending through said mounting plate and said foot plate into the bottom surface of said top plate, said fasteners holding said mounting plate and said top plate in rigid assembled relation with said foot plate, wherein said traction plate cannot be displaced relative to said foot plate.

2. The traction plate assembly of claim 1, wherein said top plate and said mounting plate are aluminum.

3. The traction plate assembly of claim 2, wherein said traction surface is knurled.

4. The traction plate assembly of claim 2, wherein said traction surface is milled to include raised traction enhancing structures.

5. The traction plate assembly of claim 1, further comprising:

a friction enhancing pad received between said bottom surface of said top plate and said foot plate.

6. The traction plate assembly of claim 1, wherein said fasteners are screws.

7. The traction plate assembly of claim 6, further comprising:

mounting lugs formed on said bottom surface of said top plate, said mounting lugs having openings therein to receive said screws, said foot plate having a thickness, said mounting lugs extending from said bottom surface of said top plate a distance less than the thickness of said foot plate.

8. The traction plate assembly of claim 1, wherein said top plate has a first end and a second end, said top plate including at least one notch in one end thereof, said notch corresponding to said yoke at the point where said yoke contacts said foot plate.

9. The traction plate assembly of claim 8, wherein said top plate includes one notch at each end thereof.

10. A stirrup assembly comprising:

an equestrian stirrup, said stirrup including a yoke, said yolk having two rigid arms and a foot plate rigidly connected to said arms, wherein said foot plate is not displaceable relative to said yoke; and a traction plate assembly including:

a top plate, said top plate having a top traction surface and a bottom mounting surface, said top plate received above said foot plate, a mounting plate, said mounting plate received below said foot plate, and fasteners, said fasteners extending through said mounting plate and said foot plate into the bottom surface of said top plate, said fasteners holding said mounting plate and said top plate in rigid assembled relation with said foot plate, wherein said traction plate cannot be displaced relative to said foot plate.

11. The stirrup assembly of claim 10, wherein said top plate and said mounting plate are aluminum.

12. The stirrup assembly of claim 11, wherein said traction surface is knurled.

13. The stirrup assembly of claim 11, wherein said traction surface is milled to include raised traction enhancing structures.

14. The stirrup assembly of claim 10, further comprising:

a friction enhancing pad received between said bottom surface of said top plate and said foot plate.

15. The stirrup assembly of claim 10, wherein said fasteners are screws.

16. The stirrup assembly of claim 15, further comprising:

mounting lugs formed on said bottom surface of said top plate, said mounting lugs having openings therein to receive said screws, said foot plate having a thickness, said mounting lugs extending from said bottom surface of said top plate a distance less than the thickness of said foot plate.

17. The stirrup assembly of claim 10, wherein said top plate has a first end and a second end, said top plate including at least one notch in one end thereof, said notch corresponding to one of said arms of said yoke at the point where said arm contacts said foot plate.

18. The stirrup assembly of claim 17, wherein said top plate includes one notch at each end thereof.

* * * * *